US008557366B2

(12) United States Patent
Harrington, Jr. et al.

(10) Patent No.: US 8,557,366 B2
(45) Date of Patent: Oct. 15, 2013

(54) ROOFING SHINGLE INCLUDING SHEET AS HEADLAP

(75) Inventors: Edward R. Harrington, Jr., Toledo, OH (US); Larry Grubka, Westerville, OH (US); Yihsein H. Teng, Westerville, OH (US); Jill Krueger, Gahanna, OH (US); Venkata S. Nagarajan, New Albany, OH (US); Marc B. Kuttler, Lancaster, OH (US); Don G. Hendershot, Columbus, OH (US); Jay D. Beck, Mt. Vernon, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1188 days.

(21) Appl. No.: 11/396,498

(22) Filed: Apr. 3, 2006

(65) Prior Publication Data

US 2007/0039274 A1 Feb. 22, 2007

(51) Int. Cl.

| | |
|---|---|
| ***D06N 7/04*** | (2006.01) |
| ***G11B 5/64*** | (2006.01) |
| ***E01F 9/04*** | (2006.01) |
| ***E04D 1/00*** | (2006.01) |

(52) U.S. Cl.
USPC ..... 428/141; 428/143; 52/518

(58) Field of Classification Search
USPC ..... 428/141, 143
See application file for complete search history.

(56) References Cited

U.S. PATENT DOCUMENTS

| | | | | |
|---|---|---|---|---|
| 1,597,135 | A | | 8/1926 | Wittenberg |
| 1,601,731 | A | | 10/1926 | Flood |
| 1,665,222 | A | | 4/1928 | Robinson |
| 1,701,926 | A | | 2/1929 | Kirschbraun |
| 1,799,500 | A | | 4/1931 | Brophy |
| 2,161,440 | A | | 6/1939 | Venrick |
| 2,798,006 | A | * | 7/1957 | Oldfield et al. ..... 428/143 |
| 2,847,948 | A | | 8/1958 | Truitt |
| 3,054,222 | A | | 9/1962 | Buckner |
| 3,082,577 | A | | 3/1963 | George et al. |
| 3,180,783 | A | | 4/1965 | Walker et al. |
| 3,247,631 | A | | 4/1966 | Lovness |

(Continued)

FOREIGN PATENT DOCUMENTS

| | | |
|---|---|---|
| CA | 1207975 | 7/1986 |
| CN | 217 6391 | 9/1994 |

(Continued)

OTHER PUBLICATIONS

Chinese Office Action for Chinese Application 2006 80028893.4 dated Mar. 27, 2009.

(Continued)

*Primary Examiner* — Maria Veronica Ewald
*Assistant Examiner* — Nathan Van Sell
(74) *Attorney, Agent, or Firm* — Calfee, Halter & Griswold LLP

(57) ABSTRACT

A roofing shingle includes a buttlap portion with a butt edge and a headlap portion with a head edge. The roofing shingle includes a coated mat which is a roofing mat coated with an organic-based coating material. The roofing shingle also includes a water impermeable sheet adjacent to the coated mat. In one embodiment, the headlap portion of the coated mat is mostly replaced by the sheet. In another embodiment, the roofing shingle has a limited width. In a further embodiment, the roofing shingle is reduced in weight compared to a conventional shingle.

3 Claims, 2 Drawing Sheets

(56) References Cited

U.S. PATENT DOCUMENTS

| | | | | |
|---|---|---|---|---|
| 3,252,257 | A | 5/1966 | Price et al. | |
| 3,332,830 | A | 7/1967 | Tomlinson et al. | |
| 3,377,762 | A | 4/1968 | Chalmers et al. | |
| 3,468,086 | A | 9/1969 | Warner | |
| 3,468,092 | A | 9/1969 | Chalmers | |
| 3,624,975 | A | 12/1971 | Morgan et al. | |
| 3,664,081 | A | 5/1972 | Martin et al. | |
| 3,848,384 | A | 11/1974 | Eaton et al. | |
| 4,301,633 | A | 11/1981 | Neumann | |
| 4,459,157 | A | 7/1984 | Koons | |
| 4,680,909 | A | 7/1987 | Stewart | |
| 4,706,435 | A | 11/1987 | Stewart | |
| 4,717,614 | A | 1/1988 | Bondoc et al. | |
| 4,755,545 | A | 7/1988 | Lalwani | |
| 4,817,358 | A | 4/1989 | Lincoln et al. | |
| 4,824,880 | A | 4/1989 | Algrim et al. | |
| 4,848,057 | A | 7/1989 | MacDonald et al. | |
| 4,952,268 | A | 8/1990 | Beck et al. | |
| 5,181,361 | A | 1/1993 | Hannah et al. | |
| 5,209,802 | A | 5/1993 | Hannah et al. | |
| 5,239,802 | A | 8/1993 | Robinson | |
| 5,251,416 | A | 10/1993 | White | |
| 5,426,902 | A | 6/1995 | Stahl et al. | |
| 5,571,596 | A | 11/1996 | Johnson | |
| 5,577,361 | A | 11/1996 | Grabek, Jr. | |
| 5,611,186 | A | 3/1997 | Weaver | |
| 5,660,014 | A | 8/1997 | Stahl et al. | |
| 5,822,943 | A * | 10/1998 | Frankoski et al. | 52/518 |
| 5,860,263 | A | 1/1999 | Sieling et al. | |
| 5,901,517 | A | 5/1999 | Stahl et al. | |
| 5,916,103 | A | 6/1999 | Roberts | |
| 5,950,387 | A | 9/1999 | Stahl et al. | |
| 6,010,589 | A | 1/2000 | Stahl et al. | |
| 6,021,611 | A | 2/2000 | Wells et al. | |
| 6,038,826 | A | 3/2000 | Stahl et al. | |
| 6,044,608 | A | 4/2000 | Stahl et al. | |
| 6,083,592 | A | 7/2000 | Chich | |
| 6,145,265 | A | 11/2000 | Malarkey et al. | |
| 6,148,578 | A | 11/2000 | Nowacek et al. | |
| 6,199,338 | B1 | 3/2001 | Hudson, Jr. et al. | |
| 6,220,329 | B1 | 4/2001 | King et al. | |
| 6,228,785 | B1 | 5/2001 | Miller et al. | |
| 6,289,648 | B1 | 9/2001 | Freshwater et al. | |
| 6,343,447 | B2 | 2/2002 | Geissels et al. | |
| 6,355,132 | B1 | 3/2002 | Becker et al. | |
| 6,397,546 | B1 | 6/2002 | Malarkey et al. | |
| 6,397,556 | B1 | 6/2002 | Karpinia | |
| 6,471,812 | B1 | 10/2002 | Thompson et al. | |
| 6,487,828 | B1 | 12/2002 | Phillips | |
| 6,523,316 | B2 | 2/2003 | Stahl et al. | |
| 6,610,147 | B2 | 8/2003 | Aschenbeck | |
| 6,679,020 | B2 | 1/2004 | Becker et al. | |
| 6,679,308 | B2 | 1/2004 | Becker et al. | |
| 6,692,608 | B2 | 2/2004 | Phillips | |
| 6,708,456 | B2 | 3/2004 | Kiik et al. | |
| 6,709,994 | B2 | 3/2004 | Miller et al. | |
| 6,758,019 | B2 | 7/2004 | Kalkanoglu et al. | |
| 6,804,919 | B2 | 10/2004 | Railkar | |
| 6,823,637 | B2 | 11/2004 | Elliott et al. | |
| 6,990,779 | B2 | 1/2006 | Kiik et al. | |
| 7,082,724 | B2 | 8/2006 | Railkar et al. | |
| 7,118,794 | B2 | 10/2006 | Kalkanoglu et al. | |
| 7,537,820 | B2 | 5/2009 | Kalkanoglu et al. | |
| 7,765,763 | B2 | 8/2010 | Teng et al. | |
| 7,781,046 | B2 | 8/2010 | Kalkanoglu et al. | |
| 7,836,654 | B2 | 11/2010 | Belt | |
| 8,156,704 | B2 | 4/2012 | Belt | |
| 8,173,243 | B2 | 5/2012 | Kalkanoglu et al. | |
| 8,181,413 | B2 | 5/2012 | Belt | |
| 8,240,102 | B2 | 8/2012 | Belt | |
| 2001/0049002 | A1 | 12/2001 | Mccumber et al. | |
| 2003/0040241 | A1 | 2/2003 | Kiik et al. | |
| 2003/0093963 | A1 | 5/2003 | Stahl et al. | |
| 2004/0055240 | A1 | 3/2004 | Kiik et al. | |
| 2004/0083673 | A1 | 5/2004 | Kalkanoglu et al. | |
| 2004/0083674 | A1 | 5/2004 | Kalkanoglu et al. | |
| 2004/0206035 | A1 | 10/2004 | Kandalgaonkar | |
| 2004/0221536 | A1 | 11/2004 | Kalkanoglu et al. | |
| 2004/0258883 | A1 | 12/2004 | Weaver | |
| 2005/0204675 | A1 | 9/2005 | Snyder et al. | |
| 2006/0032174 | A1 | 2/2006 | Floyd | |
| 2006/0179767 | A1 * | 8/2006 | Miller et al. | 52/555 |
| 2006/0265990 | A1 | 11/2006 | Kalkanoglu et al. | |
| 2007/0039274 | A1 | 2/2007 | Harrington et al. | |
| 2007/0042158 | A1 | 2/2007 | Belt | |
| 2008/0134612 | A1 | 6/2008 | Koschitzky | |
| 2009/0293404 | A1 | 12/2009 | Belt | |
| 2010/0077689 | A1 | 4/2010 | Kalkanoglu et al. | |
| 2010/0143667 | A1 | 6/2010 | Collins et al. | |
| 2010/0310825 | A1 | 12/2010 | Kalkanoglu et al. | |
| 2011/0016812 | A1 | 1/2011 | Belt | |
| 2011/0072752 | A1 | 3/2011 | Aschenbeck et al. | |
| 2011/0139366 | A1 | 6/2011 | Belt | |
| 2011/0146185 | A1 | 6/2011 | Belt | |
| 2011/0197534 | A1 | 8/2011 | Belt | |
| 2011/0232220 | A1 | 9/2011 | Belt | |
| 2011/0283646 | A1 | 11/2011 | Vermilion | |
| 2012/0047838 | A1 | 3/2012 | Kalkanoglu et al. | |
| 2013/0210666 | A1 | 8/2012 | Kalkanoglu et al. | |

FOREIGN PATENT DOCUMENTS

| | | |
|---|---|---|
| JP | 50002937 | 1/1975 |
| WO | 2007/019399 | 2/2007 |
| WO | 2007/108846 | 9/2007 |
| WO | 2008/052029 | 5/2008 |

OTHER PUBLICATIONS

International Search Report PCT/US2006/030633 dated Nov. 21, 2006.

US Office Action dated Mar. 4, 2010, U.S. Appl. No. 11/198,522, filed Aug. 5, 2005.

US Office Action dated Aug. 4, 2009, U.S. Appl. No. 11/198,522, filed Aug. 5, 2005.

US Office Action dated Sep. 30, 2008, U.S. Appl. No. 11/198,522, filed Aug. 5, 2005.

US Office Action dated Feb. 20, 2008, U.S. Appl. No. 11/198,522, filed Aug. 5, 2005.

US Office Action dated Oct. 31, 2007, U.S. Appl. No. 11/198,522, filed Aug. 5, 2005.

US Office Action dated Apr. 17, 2007, U.S. Appl. No. 11/198,522, filed Aug. 5, 2005.

International Search Report PCT/US2007/007827 dated Aug. 29, 2007.

Applicant's Submission dated Jan. 4, 2004 for U.S. Appl. No. 11/198,522.

Applicant's Submission dated Mar. 30, 2009 for U.S. Appl. No. 11/198,522.

Applicant's Submission dated Aug. 20, 2008 for U.S. Appl. No. 11/198,522.

Applicant's Submission dated Jan. 31, 2008 for U.S. Appl. No. 11/198,522.

Applicant's Submission dated Aug. 7, 2007 for U.S. Appl. No. 11/198,522.

Office Action dated Mar. 2, 2011, U.S. Appl. No. 11/997,657, filed Nov. 5, 2008.

Response to the Office Action dated Mar. 2, 2011, U.S. Appl. No. 11/997,657, filed Nov. 5, 2008.

Notification of Ground(s) for Rejection, Application No. JP2008-525265, Dated Dec. 12, 2011.

Notification of Ground(s) for Rejection Translation, Application No. JP2008-525265, Dated Dec. 12, 2011.

Office action from U.S. Appl. No. 13/193,900 dated May 14, 2013.

Interview Summary from U.S. Appl. No. 11/396,498 dated Jul. 25, 2007.

Interview Summary from U.S. Appl. No. 11/198,522 dated Aug. 11, 2008.

Notice of Allowance from U.S. Appl. No. 11/198,522 dated Oct. 5, 2010.

(56) References Cited

OTHER PUBLICATIONS

Office action from U.S. Appl. No. 11/997,657 dated Mar. 2, 2011.
Office action from U.S. Appl. No. 11/997,657 dated Aug. 12, 2011.
Interview Summary from U.S. Appl. No. 11/997,657 dated Oct. 14, 2011.
Office action from U.S. Appl. No. 11/997,657 dated Nov. 9, 2011.
Interview Summary from U.S. Appl. No. 11/997,657 dated Jan. 11, 2012.
Interview Summary from U.S. Appl. No. 11/997,657 dated Jan. 30, 2012.
Interview Summary from U.S. Appl. No. 11/997,657 dated Mar. 5, 2012.
Office action from U.S. Appl. No. 11/997,657 dated Apr. 11, 2012.
Notice of Allowance from U.S. Appl. No. 11/997,657 dated May 9, 2012.
Office action from U.S. Appl. No. 12/895,195 dated Dec. 22, 2010.
Office action from U.S. Appl. No. 12/895,195 dated May 11, 2011.
Notice of Allowance from U.S. Appl. No. 12/895,195 dated Feb. 28, 2011.
Office action from U.S. Appl. No. 12/895,195 dated Oct. 13, 2011.
Notice of Allowance from U.S. Appl. No. 12/895,195 dated Feb. 29, 2012.
Office action from U.S. Appl. No. 13/036,200 dated Aug. 3, 2011.
Interview Summary from U.S. Appl. No. 13/036,200 dated Sep. 29, 2011.
Interview Summary from U.S. Appl. No. 13/036,200 dated Dec. 30, 2011.
Office action from U.S. Appl. No. 13/036,200 dated Jan. 25, 2012.
Office action from U.S. Appl. No. 13/036,200 dated May 15, 2012.
Interview Summary from U.S. Appl. No. 13/036,200 dated Jun. 27, 2012.
Notice of Allowance from U.S. Appl. No. 13/036,200 dated Jul. 17, 2012.
Notice of Allowance from U.S. Appl. No. 13/036,200 dated Feb. 5, 2013.
Office action from U.S. Appl. No. 13/036,356 dated May 11, 2011.
Office action from U.S. Appl. No. 13/036,356 dated Oct. 4, 2011.
Interview Summary from U.S. Appl. No. 13/036,356 dated Dec. 29, 2011.
Notice of Allowance from U.S. Appl. No. 13/036,356 dated Jan. 23, 2012.
Office action from U.S. Appl. No. 13/097,810 dated Aug. 29, 2012.
Office action from U.S. Appl. No. 13/155,600 dated Sep. 15, 2011.
Notice of Abandonment from U.S. Appl. No. 13/155,600 dated Mar. 22, 2012.
Office action from Japanese Application No. 2008-525265 dated Nov. 5, 2012.
Notice of Allowance from U.S. Appl. No. 13/097,810 dated Feb. 25, 2013.
Notice of Allowance from U.S. Appl. No. 13/097,810 dated Apr. 10, 2013.
Notice of Allowance from U.S. Appl. No. 13/036,200 dated May 23, 2013.
Notice of Allowance from U.S. Appl. No. 13/097,810 dated Aug. 20, 2013.

* cited by examiner

ROOFING SHINGLE INCLUDING SHEET AS HEADLAP

CROSS-REFERENCE TO RELATED APPLICATION

U.S. patent application Ser. No. 11/198,522 filed Aug. 5, 2005, entitled "Shingle with Reinforced Nail Zone and Method of Manufacturing", is incorporated by reference herein in its entirety (the '522 application).

TECHNICAL FIELD

This invention relates in general to the field of roof coverings, and in particular the invention is useful in the manufacture of asphalt-based roofing shingles.

BACKGROUND OF THE INVENTION

Typical asphalt-based roofing shingles include a roofing mat coated with asphalt and covered with a layer of roofing granules. The shingles include a buttlap portion that is exposed when the shingles are installed on a roof and a headlap portion that is covered by the upper adjacent course of shingles when the shingles are installed on a roof. Laminated roofing shingles also include an overlay made from a second asphalt-coated mat on the buttlap portion of the shingles.

U.S. Pat. No. 6,990,779 B2 to Kiik et al. (Elk Premium Building Products) discloses a roofing system having alternating courses of roofing shingles and interply material. The roofing shingles are constructed to have a wider buttlap portion and a narrower headlap portion. The interply material can be comprised of a substrate having an ionic charge coated on both sides with a coating having essentially the same ionic charge, and a water impermeable plastic film or metal foil on one or both sides of the coated substrate. A roofing shingle is commercially available from Elk in which a sheet of interply material is attached to the headlap portion of the shingle.

The following patents disclose metal or plastic sheets attached to the buttlap portions of roofing shingles: U.S. Pat. Nos. 1,655,222; 1,799,500; 2,847,948; 3,377,762; and 3,468,092.

SUMMARY OF THE INVENTION

This invention relates to a roofing shingle including a buttlap portion with a butt edge and a headlap portion with a head edge. The roofing shingle includes a coated mat comprising a roofing mat coated with an organic-based coating material. In one embodiment, the coated mat has a width that extends entirely through the buttlap portion and does not extend more than about 10% into the headlap portion of the roofing shingle. The roofing shingle also includes a water impermeable sheet adjacent to the coated mat. The sheet has a width that extends from the head edge through at least about 90% of the headlap portion and does not extend to the butt edge of the roofing shingle.

In another embodiment, the invention relates to a roofing shingle including a buttlap portion with a butt edge and a headlap portion with a head edge. The roofing shingle includes a coated mat comprising a roofing mat coated with an organic-based coating material. The coated mat has a width that extends entirely through the buttlap portion and does not extend to the head edge of the roofing shingle. The roofing shingle also includes a water impermeable sheet having a width that extends from the head edge of the roofing shingle and adjacent to the coated mat. The roofing shingle has a limited width characterized by at least one of the following: (a) the entire roofing shingle has a width of not more than about 17 inches (about 43 cm), (b) the buttlap portion of the roofing shingle has a width of not more than about 7 inches (about 18 cm), and (c) the sheet has a width of not more than 8 inches (about 20 cm).

In another embodiment, the invention relates to a roofing shingle including a buttlap portion with a butt edge and a headlap portion with a head edge. The roofing shingle includes a coated mat comprising a roofing mat coated with an organic-based coating material. The coated mat has a width that extends entirely through the buttlap portion and does not extend to the head edge of the roofing shingle. The roofing shingle also includes a water impermeable sheet having a width that extends from the head edge of the roofing shingle and adjacent to the coated mat. The roofing shingle has a weight reduction of at least about 25% compared to a conventional roofing shingle without the sheet and having the coated mat extending the complete width of the shingle, and preferably a weight reduction of at least about 40%.

In another embodiment, the invention relates to a roofing shingle including a buttlap portion with a butt edge and a headlap portion. The roofing shingle includes a coated mat comprising a roofing mat coated with an organic-based coating material. The coated mat has a width that extends entirely through the buttlap and headlap portions of the roofing shingle. The roofing shingle also includes a layer of roofing granules adhered to the coating material in the buttlap portion. However, the roofing granules are substantially excluded in a non-granule area having a width that extends through at least most of the headlap portion. The roofing shingle further includes a water impermeable sheet adjacent to the coated mat. The sheet has a width that extends through at least the non-granule area and does not extend to the butt edge of the roofing shingle.

In a further embodiment, the invention relates to a roofing shingle including a buttlap portion and a headlap portion. The roofing shingle includes a coated mat comprising a roofing mat coated with an organic-based coating material. A sealant is applied on a back surface of the coated mat in the buttlap portion of the roofing shingle. A reinforcement member or a water impermeable sheet is attached to the coated mat and forms a top surface of the roofing shingle that is located at least partly in the headlap portion. The sealant and the reinforcement member or the water impermeable sheet are positioned such that when a second identical shingle is laid over the headlap portion of the shingle, the sealant on the back surface of the second shingle comes into contact with the reinforcement member or the water impermeable sheet, thereby creating a strong bond between the shingles that can improve the wind resistance of the shingles on a roof.

DETAILED DESCRIPTION AND PREFERRED EMBODIMENTS OF THE INVENTION

Figure 1:
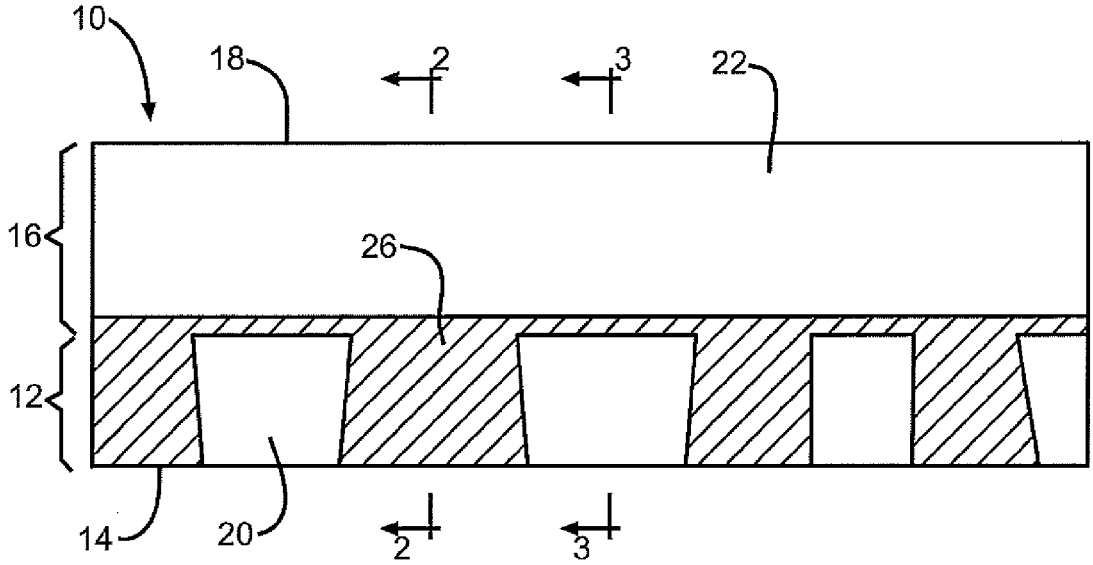
FIG. 1 is a top view of a roofing shingle according to one embodiment of the invention.

The roofing shingles of the invention can be laminated or non-laminated (e.g., three-tab) shingles. As known in the roofing industry, non-laminated shingles may be made with or without tabs, and three-tab roofing shingles usually include three tabs in the buttlap portion of the shingle and relatively narrow cutouts between the tabs. Laminated roofing shingles usually include an overlay that extends the entire width of the shingle and includes relatively wide cutouts in the buttlap portion of the shingle, and an underlay positioned below the overlay that extends the width of the buttlap portion under the cutouts and a short distance into the headlap portion of the shingle. Numerous alternate laminate constructions are available, such as full length laminates, trilaminates, and other constructions known to one skilled in the art.

The buttlap is the portion of the roofing shingle that is exposed when the shingle is installed on a roof, and the headlap is the portion of the roofing shingle that is not exposed when the shingle is installed on a roof because it is covered by the adjacent upper row of shingles. On a laminated roofing shingle or a three-tab roofing shingle, the buttlap portion usually extends about to the inner edge of the cutouts. If the cutouts have different widths, the buttlap portion usually extends about to the inner edge of the cutout(s) with the largest width. The lower edge of the roofing shingle is often referred to as the butt edge while the upper edge of the shingle may be referred to as the head edge.

As discussed below, a preferred roofing shingle of the invention includes a coated roofing mat and a water impermeable sheet. The term "roofing shingle", as used herein, includes the sheet attached to the coated roofing mat, and it also includes an assembly of the sheet and the coated roofing mat where the sheet is adjacent to the mat but not attached to it. For example, the sheet may be attached to the roof separately from the coated roofing mat and/or it may be attached to the coated roofing mat when it is installed on the roof. Alternatively, the sheet may be unattached on the roof but held in place by the adjacent upper and lower coated roofing mats or by other means. In an alternative embodiment, the sheet comprises the reinforcement for the wide nail zone, as described in copending application 11/198,522.

The coated roofing mat includes a roofing mat typically coated with an organic-based coating material. The roofing mat can be any type suitable for reinforcing the roofing shingle, such as a web, scrim or felt of synthetic or natural fibrous materials, including nonwoven or woven mats. The fibrous materials may include, for example, mineral fibers, polymer fibers, carbon fibers, cellulose fibers, rag fibers, or mixtures of these fibers. Suitable mineral fibers may include fibers of a heat-softenable mineral material, such as glass, ceramic, rock, slag, or basalt. In one embodiment, the roofing mat is a nonwoven web of glass fibers.

The organic-based coating material can be any type suitable for use on a roofing shingle. Typically, the coating material is a bituminous material and/or a polymeric material (e.g., a polymer, a recycled polymer stream or ground tire rubber). Any type of suitable bituminous material can be used, such as asphalt, tar, pitch, or a mixture thereof. By "organic-based" is meant that the organic material forms the continuous phase of the coating material. The coating material usually includes at least about 20% organic material by weight, and often at least about 40%. The coating material can also include various additives and/or modifiers, such as inorganic fillers or mineral stabilizers. In a typical asphalt roofing shingle, the coating material includes asphalt and a filler of finely ground inorganic particulate matter, such as ground limestone, dolomite or silica, in an amount of from about 40% to about 80% by weight of the coating material.

The water impermeable sheet can be any type suitable for use on a roofing shingle. By "water impermeable" is meant that the sheet forms a barrier that substantially prevents penetration by water through the sheet during normal use of the roofing shingles on a roof. Optionally, the water impermeability of the sheet can be tested by any suitable method, for example, by placing 0.5 liter of water at room temperature over a section of the sheet having an area of 400 $cm^2$, and observing no substantial penetration of the sheet by the water after 24 hours. The sheet can have any thickness suitable for providing the water barrier, although relatively thin sheets are usually preferred for cost and weight reduction. The term "sheet" includes films, membranes, tapes, foils, and the like, usually in substantially continuous form. Alternatively, the "sheet" may be formed on site by extruding a polymer sheet, or by applying a liquid to the surface of the coated mat 38 by rolling, spraying, or other known processes.

In some embodiments, the sheet is made from a polymer or a metal. Any suitable polymer or mixture of different polymers can be used to make the sheet. For example, the polymer can be a polyolefin such as polypropylene, polyethylene, polybutene, or polyisoprene. Some other examples of polymers that may be suitable include polypropylene, polyethylene, polyester terephthalate, polyester, polyethylene terephthalate, polyvinyl chloride, EPDM (terpolymer elastomer made from ethylene-propylene diene monomer), and other polymers and polymer blends known to one skilled in the art. The polymer may be high or low density. A polymer sheet may also include additives to improve the flame retardancy of the sheet, as known to one skilled in the art. Furthermore, the sheet materials can be chemically treated or surface charged to improve properties.

Any suitable metal or combination of metals can be used to make the sheet. Recycled metals can also be used. Some examples of metals that may be suitable include aluminum and copper.

Preferably, the sheet is a nonlaminated sheet made from polymer or metal. It is also preferred that the sheet does not have an ionic charge.

The sheet may also be made from a roofing mat as described above, provided the mat is made sufficiently water impermeable by coating or other means.

In the embodiments of the invention where the sheet is attached to the coated mat, these materials can be attached together by any suitable means. For example, they can be attached by the use of any suitable type of adhesive. Some examples of adhesives that may be suitable include polymeric hot-melt adhesives and modified asphalt hot-melt adhesives. Alternatively, the sheet and the coated mat can be attached together by mechanical means such as by sewing, stitching, stapling, or by the use of any other suitable fasteners, or may be adhered to the coating material in molten form.

The roofing shingles of the invention may provide advantages compared to conventional shingles. In one embodiment of the invention, roofing shingles are made in which the headlap portion of a conventional shingle is mostly replaced with the water impermeable sheet. The replacement of most of the headlap portion may provide weight and cost advantages. A reduction in the weight of the shingle could provide freight and installation benefits. Replacing most of the headlap portion of the shingle could increase the capacity of existing shingle manufacturing lines and reduce the amount of raw material brought into a plant.

Figure 2:
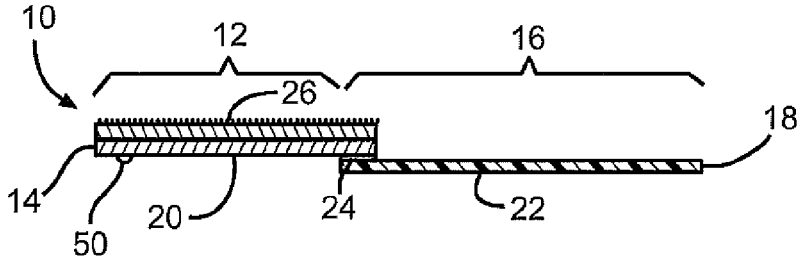
FIG. 2 is a cross-sectional view taken along line 2-2 of FIG. 1.
Figure 3:
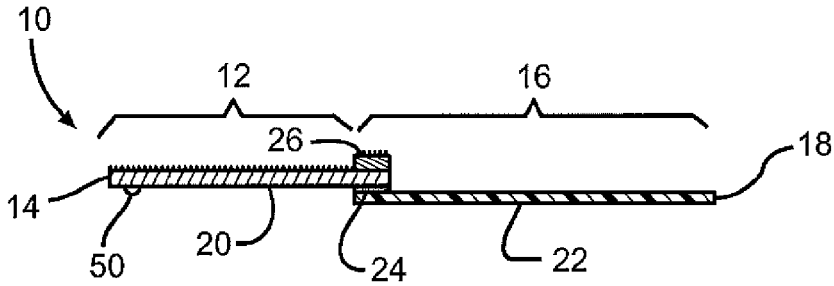
FIG. 3 is a cross-sectional view taken along line 3-3 of FIG. 1.

Referring now to the drawings, FIGS. 1-3 illustrate an embodiment of the invention in which most of the headlap portion of a conventional roofing shingle is replaced with the water impermeable sheet. The roofing shingle 10 includes a buttlap portion 12 with a butt edge 14 and a headlap portion 16 with a head edge 18. The roofing shingle includes a coated mat 20 comprising a roofing mat coated with an organic-based coating material. The coated mat 20 has a width that extends entirely through the buttlap portion 12 and preferably does not extend more than 20% into the headlap portion 16 of the shingle. In some embodiments, the coated mat 20 does not extend more than 15%, 10% or 5% of the distance into the headlap portion 16. The roofing shingle 10 also includes a water impermeable sheet 22 adjacent to the coated mat. The term "adjacent", as used herein, includes overlapping or end-to-end. Either the coated mat 20 or the sheet 22 can be on top when they overlap. In the illustrated embodiment, the coated mat 20 and the sheet 22 overlap a short distance into the headlap portion 16 of the roofing shingle and they are attached together by an adhesive 24. The sheet 22 has a width that extends from the head edge 18 through at least 80% of the headlap portion 16 and does not extend to the butt edge 14 of the roofing shingle. In some embodiments, the sheet 22 extends through at least 85%, 90% or 95% of the headlap portion 16. The illustrated roofing shingle is a laminated shingle in which the coated mat 20 is the underlay, and the shingle further includes an overlay in the form of a second coated mat 26 cut in a dragon-tooth pattern. In a laminated shingle, the end of the sheet 22 could alternatively be attached between the overlay and the underlay, although it is usually positioned either above the overlay or below the underlay. Although the figures relate to a laminated roofing shingle, the invention also includes non-laminated roofing shingles as discussed above.

The second coated mat 26 is adhered to the first coated mat 20 using a laminate adhesive as is well known to one skilled in the art. The shingle further includes a sealant, preferably a polymer modified asphalt (PMA) such as described in commonly assigned U.S. Pat. No. 4,824,880 to Algrim et al, which is incorporated herein by reference in its entirety (the '880 patent). A preferred laminate adhesive includes a polymer-modified asphalt, typically including one or more styrene block polymer materials, such as those taught in the sealant of the '880 patent. In a preferred embodiment, the adhesive comprises less than ten percent by weight of polymer material, up to sixty percent or more of a mineral filler, such as limestone or dolomite, and the balance being primarily asphalt, and may include additional other modifiers and such, including for example extender oils, acid treatments and other known modifiers in the asphalt industry. The filler percentage may be more or less, depending on adhesive properties needed, but typically at least about forty percent filler is desirable. For improved economy and adhesion, more preferably, the polymer is less than six percent, and even more preferably about four percent or less. As an adhesive, it is preferable the asphalt has a penetration greater than 8 dmm at 77 F and a softening point greater than 130 F, and more preferably greater than 10 dmm pen and 150 F SP.

The roofing shingles of the invention can also be characterized in terms of their limited width. The roofing shingles disclosed in U.S. Pat. No. 6,990,779 B2 (Elk) use conventional width shingles but increase the width of the buttlap portion of the shingles. Then an interply material is attached to the head edge of the shingle. For purpose of comparison with the roofing shingles of the invention, if the "shingle" disclosed in U.S. Pat. No. 6,990,779 is considered to be the combination of the roofing shingle and the interply material, the shingle has a greatly increased width compared to conventional shingles. In contrast, the roofing shingles of the invention can replace most of the headlap portion of the shingles with the water impermeable sheet, and therefore the total width of the shingles is not greatly increased compared to conventional shingles, and in some embodiments the total width is the same as conventional shingles.

Thus, a preferred roofing shingle according to the invention may have a limited width characterized by at least one of the following: (a) the entire roofing shingle (including the coated mat and the water impermeable sheet) has a width of not more than about 17 inches (about 43 cm), and preferably not more than about 15 inches (about 38 cm), (b) the buttlap portion of the roofing shingle has a width of not more than about 7 inches (about 18 cm), and preferably not more than 6 inches (about 15 cm), and (c) the sheet has a width of not more than 8 inches (about 20 cm), and preferably not more than 7 inches (about 18 cm). In some embodiments, the limited width of the roofing shingle is characterized by at least two of (a), (b) and (c), and in some embodiments by all three of (a), (b) and (c). Alternatively, other size shingles, such as larger format shingles, for example the Berkshire® shingle sold by Owens Corning, can be made using the present invention, using proportionally sized buttlap and sheet materials.

Replacing most of the headlap portion of the roofing shingles with the water impermeable sheet can allow shingles to be made in which the overall weight of the shingles is decreased compared to conventional shingles, in contrast to the roofing shingles disclosed in U.S. Pat. No. 6,990,779 B2 which will be increased in weight. For example, the roofing shingle may have a weight reduction of at least about 25% compared to another roofing shingle that is identical except that it does not include the water impermeable sheet and the coated mat extends the full width of the roofing shingle, and sometimes a weight reduction of at least about 40%.

While not illustrated in the Figures, the lower portion of the sheet may be printed with lines or other markings to indicate a preferred nail zone for attaching the shingle to the roof. Such a nail zone is described in the '522 application. However, where the sheet covers substantially the entire headlap area, a preferred embodiment provides a nail zone between the bottom of the exposed portion of the film and a line provided on the film parallel to the bottom of the film (or other markings). Accordingly, the sheet provides the function of the reinforcement described and claimed in the '522 application. Alternatively, the film may be located above the nail zone region, and a separate reinforcement applied to the nail zone as described in the '522 application. In yet a further alternative embodiment, the nail zone may be marked by another material to indicate the nail zone, such as e.g. a line of granules having a different color, or another material, such as sand or a lightweight material and/or of a finer grade than the granules to reduce thickness in this region and/or the entire headlap area to reduce the weight of the shingle and improve the bundle flatness.

Figure 4:
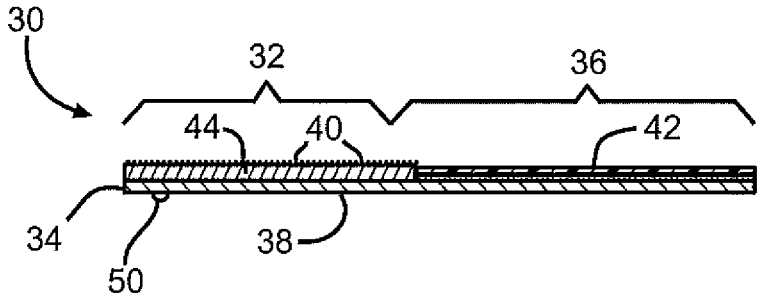
FIG. 4 is a cross-sectional view of a roofing shingle according to an alternate embodiment of the invention.
Figure 5:
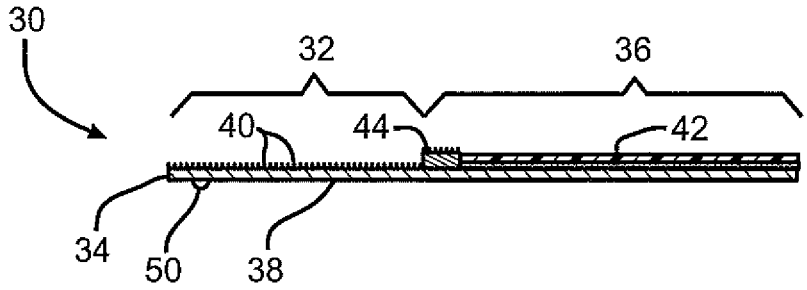
FIG. 5 is a different cross-sectional view of the alternate embodiment roofing shingle of the invention.

FIGS. 4-5 illustrate another embodiment of the invention in which the buttlap portion of the roofing shingle is coated with roofing granules, but the use of the water impermeable sheet allows the shingles to be made without roofing granules on at least most of the headlap portion of the shingles. The roofing shingle 30 includes a buttlap portion 32 with a butt edge 34 and a headlap portion 36. The roofing shingle includes a coated mat 38 comprising a roofing mat coated with an organic-based coating material. The coated mat 38 has a width that extends entirely through the buttlap 32 and headlap 36 portions of the roofing shingle. A layer of roofing granules 40 is adhered to the coating material in the buttlap portion 32.

However, the roofing granules are substantially excluded in a non-granule area having a width that extends through at least most (at least more than 50%, preferably at least more than 80%) of the headlap portion 36. The roofing shingle also includes the water impermeable sheet 42 adjacent to the coated mat 38. The sheet 42 has a width that extends entirely through at least the non-granule area and does not extend to the butt edge 34 of the roofing shingle. Although the sheet 42 is attached above the coated mat 38 in the embodiment shown, alternatively it could be attached below the coated mat. The illustrated roofing shingle is a laminated shingle in which the coated mat 38 is the underlay, and the shingle further includes an overlay in the form of a second coated mat 44. Optionally, a UV resistant material could be added to the coating in the headlap portion and/or a layer of backdust material could be applied instead of roofing granules in the non-granule area.

In an alternative embodiment, a shingle may comprise a strip shingle, and the second coated mat 44 would not be present. In such an embodiment, the buttlap portion of the sheet 38 would be covered by granules (similar to that shown in the cutout areas shown in FIG. 5 below the overlay 44). When a strip shingle comprises a tabbed shingle, the sheet 42 must have a color and appearance which is acceptable through the tab cutouts, and should include a UV inhibitor.

In a further embodiment, the invention relates to a roofing shingle including a buttlap portion with a butt edge and a headlap portion. The roofing shingle includes a coated mat comprising a roofing mat coated with an organic-based coating material. The coated mat has a width that extends entirely through the buttlap and headlap portions of the roofing shingle. The roofing shingle also includes a layer of roofing granules adhered to the coating material in the buttlap portion. However, the roofing granules are substantially excluded in a non-granule area having a width that extends through at least most of the headlap portion. The roofing shingle further includes a water impermeable sheet adjacent to the coated mat. The sheet has a width that extends through at least the non-granule area and does not extend to the butt edge of the roofing shingle.

It is known to include an adhesive material known as a sealant on roofing shingles to seal the shingles together when they are installed on a roof For example, a typical laminated roofing shingle includes a line of sealant on the back surface of the shingle near the butt edge, as clearly shown at 50 in FIGS. 2 through 5. When the next upper row of shingles is installed on the roof, the upper shingles cover the headlap portions of the lower shingles, and the sealant causes the back surfaces of the upper shingles to adhere to the top surfaces of the lower shingles. Sealing the shingles together on the roof helps to prevent wind uplift of the shingles. The sealant can be any suitable adhesive material, such as an adhesive made from asphalt, a polymer, or a combination of asphalt and polymer. The sealant can be applied in a discontinuous or continuous manner, and in any suitable configuration, and alternatively may be applied to the upper surface of the shingle to seal to the bottom of the adjacent course of shingles.

Advantageously, the roofing shingles of the present invention, and the reinforced nail zone shingles disclosed in U.S. Ser. No. 11/198,522, can improve the wind resistance of the shingles by improving the adhesion between the shingles when they are sealed together on the roof. As described above, the shingles of the present invention include a water impermeable sheet, such as a polymer or metallic sheet, in the headlap portion of the shingle. Similarly, the reinforced nail zone shingles include a reinforcement member, typically made from a polymer, adhered to the headlap portion of the shingle. The sheet or the reinforcement member can be positioned on the shingle so that when the next upper row of shingles is installed on the roof, the sealant on the back of an upper shingle comes into contact with the sheet or reinforcement member on the lower shingle. The sealant may adhere better to a polymer or metallic material than to an asphalt-based coating material with roofing granules on a typical roofing shingle, and preferably the sealant comprises a polymer modified asphalt sealant such as those taught in the '880 patent, or a variation thereof. A preferred film for comprises a polymer having good adhesion to a polymer modified asphalt, such as a surface charged PET material. Additionally, the film may be mechanically locked to the coated mat by physical overlap of granules (i.e. the granules are preferably dropped onto the sheet after the film is applied, and the granules are adhered to the molten organic-based coating material, and a number of the granules will extend over the film and mechanically lock the film, as the granule will be adhered to the sheet by the organic-based coating material after solidification). One skilled in the art will further improve adhesion of the film by applying pressure to the film at application to imbed the film into the coating, as well as the further mechanical interlock of the granules after the granules are pressed into the sheet.

Thus, another embodiment of the invention relates to a roofing shingle including a buttlap portion and a headlap portion. The roofing shingle includes a coated mat comprising a roofing mat coated with an organic-based coating material. A sealant is applied on a back surface of the coated mat in the buttlap portion of the roofing shingle. A reinforcement member or a water impermeable sheet is attached to the coated mat and forms a top surface of the roofing shingle that is located at least partly in the headlap portion. The sealant and the reinforcement member or the water impermeable sheet are positioned such that when a second identical shingle is laid over the headlap portion of the shingle, the sealant on the back surface of the second shingle comes into contact with the reinforcement member or the water impermeable sheet, thereby creating a strong bond between the shingles. Preferably, the sealant forms a bond with the reinforcement member or the water impermeable sheet that it at least twice as strong at 21° C. as the bond between the sealant and an asphalt-based coating material containing 40% asphalt and 60% ground limestone, and more preferably at least three times as strong. To enhance the bonding, in a preferred embodiment of the invention the sealant is a polymer modified asphalt and/or the reinforcement member or the water impermeable sheet is a polymer film. A specific example of a preferred polymer film is a polyester terephthalate film.

In addition to the improved wind resistance caused by the improved bonding between the shingles, the invention may also provide other advantages. For example, the sealant may be able to seal faster than a sealant on a conventional roofing shingle, because a sealant to film bond is quicker than a sealant to asphalt/granule bond. Preferably, the sealant is able to seal at least 50% faster. The sealant may also be able to develop a stronger bond at lower temperatures than a sealant on a conventional roofing shingle.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A roofing shingle consisting essentially of:

a roofing mat coated with an organic-based coating material, the coated roofing mat having a trailing edge; and a single layer, water impermeable sheet made from plastic or metal and attached to the coated roofing mat, the water impermeable sheet having a leading edge;

wherein the leading edge of the water impermeable sheet is attached to the trailing edge of the coated roofing mat at a butt joint.

2. The roofing shingle of claim 1, wherein the coated roofing mat has a mat width, the water impermeable sheet has a sheet width, and the roofing shingle has a width that is the sum of the mat width and the sheet width.

3. The roofing shingle of claim 1, wherein the water impermeable sheet and the coated roofing mat do not overlap.

* * * * *